US005245591A

United States Patent [19]

Katou

[11] Patent Number: 5,245,591

[45] Date of Patent: Sep. 14, 1993

[54] ANALOG TIMEPIECE

[75] Inventor: Ikuo Katou, Kitakatsushika, Japan

[73] Assignee: Rhythm Watch Co., Ltd., Tokyo, Japan

[21] Appl. No.: 892,588

[22] Filed: Jun. 3, 1992

[30] Foreign Application Priority Data

Oct. 2, 1991 [JP] Japan ..... 3-255217

[51] Int. Cl.[5] ..... G04B 19/04; G04B 19/24

[52] U.S. Cl. ..... 368/80; 368/187

[58] Field of Search ..... 368/76, 80, 157, 159, 368/160, 185, 187

[56] References Cited

U.S. PATENT DOCUMENTS

| | | | |
|---|---|---|---|
| 4,121,415 | 10/1978 | Crutcher et al. | 368/240 |
| 4,398,831 | 8/1983 | Fatton et al. | 368/76 |
| 4,523,857 | 6/1985 | Ushikoshi | 368/157 |
| 4,623,260 | 11/1986 | Kamiyama | 368/80 |
| 5,016,231 | 5/1991 | Kawaguchi et al. | 368/80 |
| 5,119,349 | 6/1992 | Muto et al. | 368/157 |

FOREIGN PATENT DOCUMENTS 63-17030 5/1988 Japan .

*Primary Examiner*—Vit W. Miska

[57] ABSTRACT

An analog timepiece has a standard signal generator, a reversely rotatable minute pulse motor and a reversely rotatable hour pulse motor. Current time is measured based on a standard signal from the standard signal generator and stored in a current time memory. The current time stored in the current time memory is converted to a minute hand desired position and an hour hand desired position which are stored in a desired position memory. A minute hand indicating position indicated by a minute hand and an hour hand indicating position indicated by an hour hand are stored in an indicating position memory. The minute pulse motor and the hour pulse motor are driven until the minute hand indicating position and the hour hand indicating position coincide with the minute hand and hour hand desired positions.

9 Claims, 15 Drawing Sheets

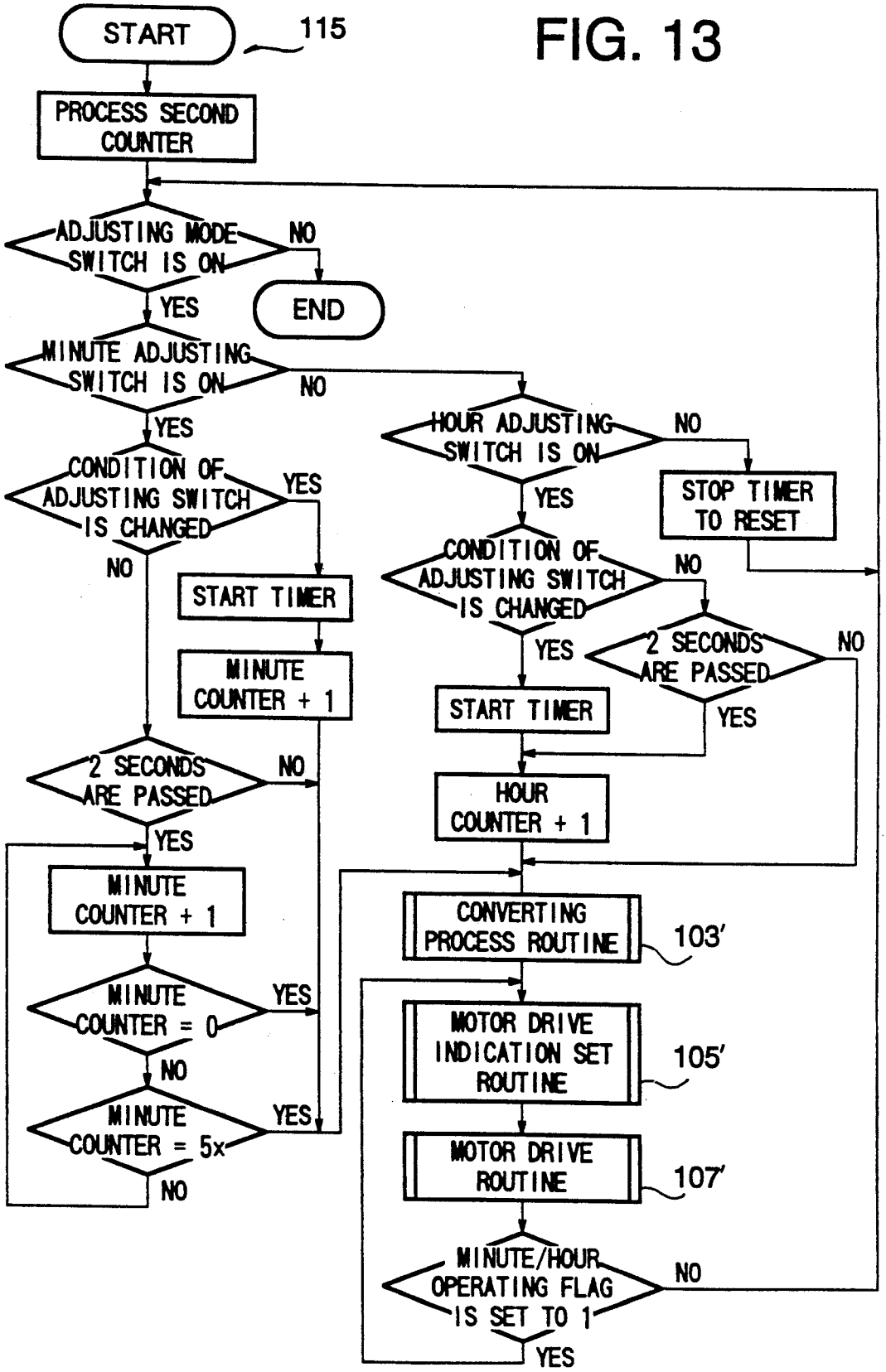
FIG. 13
START
115
PROCESS SECOND COUNTER
ADJUSTING MODE SWITCH IS ON
NO
END
YES
MINUTE ADJUSTING SWITCH IS ON
NO
YES
CONDITION OF ADJUSTING SWITCH IS CHANGED
YES
NO
START TIMER
MINUTE COUNTER + 1
2 SECONDS ARE PASSED
NO
YES
MINUTE COUNTER + 1
MINUTE COUNTER = 0
YES
NO
MINUTE COUNTER = 5x
YES
NO
HOUR ADJUSTING SWITCH IS ON
NO
YES
STOP TIMER TO RESET
CONDITION OF ADJUSTING SWITCH IS CHANGED
NO
YES
2 SECONDS ARE PASSED
NO
YES
START TIMER
HOUR COUNTER + 1
CONVERTING PROCESS ROUTINE
103'
MOTOR DRIVE INDICATION SET ROUTINE
105'
MOTOR DRIVE ROUTINE
107'
MINUTE/HOUR OPERATING FLAG IS SET TO 1
NO
YES

START
118

MONITOR FLAG IS SET TO 1
YES
NO
4
SET MONITOR FLAG
START TIMER
FIRST SETTING SWITCH IS ON
YES
NO
SECOND SETTING SWITCH IS ON
YES
NO
SECOND SETTING SWITCH IS ON
YES
NO
MIN = 0
MAX = 119
MIN = 0
MAX = 179
MIN = 0
MAX = 239
MIN = 5
MAX = 355
MINUTE HAND DESIRED POSITION = MIN
HOUR HAND DESIRED POSITION = MAX
3

ANALOG TIMEPIECE

BACKGROUND OF THE INVENTION

The present invention relates to an analog timepiece such as an analog watch, having a plurality of pulse motors which are capable of reversely rotating, and more particularly to a system for individually controlling an hour hand and a minute hand thereof with the plurality of pulse motors.

Recently, similar to a digital watch, an analog watch is provided with a quartz oscillator which produces standard pulse signals and pulse motors are accurately driven based on the standard pulse signals.

Pulse motors are provided for individually driving the hour hand and the minute hand. Pulse motors capable of reversely rotating are employed so that the minute hand and the hour hand may be driven in the range of 120 degrees or 180 degrees. Thus, various shapes of dials and designs of watches can be provided. Japanese Utility Model Publication 63-17030 discloses such an analog watch.

However, in the conventional analog watch, the reversely rotatable pulse motor is used only for adjusting the time by reversely rotating the hour hand or the minute hand.

SUMMARY OF THE INVENTION

An object of the present invention is to provide a system for controlling an analog timepiece which has multifunction and design variation in the dial of the watch by effectively using reversely rotatable pulse motors.

According to the present invention, there is provided an analog timepiece having a standard signal generator, a reversely rotatable minute pulse motor and a reversely rotatable hour pulse motor which are operated by a standard signal from the standard signal generator, and time adjusting means for adjusting a time represented by a minute hand and an hour hand.

The timepiece comprises time measuring means for producing a current time based on the standard signal fed from the standard signal generator, a current time memory for storing the current time, converting means for producing a minute hand desired position and an hour hand desired position by converting a signal from the current time stored in the current time memory with a scale factor, a desired position memory for storing the minute hand desired position and the hour hand desired position, an indicating position memory for storing a minute hand indicating position indicated by a minute hand and an hour hand indicating position indicated by an hour hand.

A comparator is provided for comparing the stored minute hand indicating position and the stored hour hand indicating position with the stored minute hand desired position and with the stored hour hand desired position respectively and for producing a minute hand rotating direction signal and an hour hand rotating direction signal in accordance with respective differences based on the comparison.

A motor driving means is provided for producing a minute pulse signal to operate the minute pulse motor and for producing an hour pulse signal to operate the hour pulse motor in respective directions determined by the minute hand and hour hand rotating direction signals when said differences exist, whereby the minute hand and the hour hand are rotated.

The time adjusting means comprises input means for inputting a time adjusting signal, incrementing means responsive to the time adjusting signal for incrementing the number stored in the current time memory with a predetermined value, whereby the desired positions of the minute and hour hands are increased by the converting means, thereby operating the motors to rotate both the hands.

In an aspect of the present invention, the time adjusting means comprises, a minute adjusting switch and an hour adjusting switch for inputting a minute adjusting signal and an hour adjusting signal, first incrementing means responsive to the minute and hour adjusting signals for incrementing numbers stored in a minute memory and an hour memory in the current time memory with one respectively at every input of the adjusting signals, first determining means for producing a quick adjusting signal when the minute adjusting switch is operated over a predetermined time, second incrementing means responsive to the quick adjusting signal for incrementing the number stored in the minute memory with five, whereby the desired positions of the minute hand is increased by the converting means, thereby operating the motor to rotate the minute hand by 30 degrees corresponding to five as long as the minute adjusting switch is operated.

In another aspect, angular range setting means is provided for setting an angular range, including a sector range smaller than 360 degrees, in which the minute hand and the hour hand are driven, the converting means operated to change the scale factor in accordance with the angular range set by the angular range setting means so as to drive the minute hand and the hour hand within the set range.

A monitor means may be provided. The monitor means comprises input means for inputting one of a maximum desired position and a minimum desired position of the minute hand and one of a minimum desired position and a maximum desired position of the hour hand in the desired position memory, second determining means for determining a coincidence of the hand indicating position stored in the indicating position memory and the desired position stored in the desired position memory and for producing a coincidence signal, and changing means responsive to the coincidence signal for changing the stored maximum desired position into the minimum desired position, and changing the stored minimum desired position into the maximum desired position, whereby the minute hand and the hour hand are continuously reciprocated between the maximum and minimum positions. Thus, the minute hand and the hour hand are quickly reciprocated.

In a watch having a sector dial, a minute hand contact switch and an hour hand contact switch are located at a position outwardly deviated from a zero position on a dial having a sector range. After a shaft of the minute hand and a shaft of the hour hand are located at the positions of the minute hand switch and the hour hand switch, both the shafts are moved to a zero position.

A carry control means is provided for inhibiting the time measuring means from carrying of hour count during minute adjusting operation. Therefore, it is not necessary to correct the position of the hour hand in the time adjusting operation.

In a further aspect, the watch further comprises a hand shaft centering switch for producing a shaft centering signal, and drive means responsive to the shaft centering signal for rotating the minute hand and the hour hand to an angular position corresponding to a central position of a dial having a sector range. Since the shaft is located at the central position, the hand can be easily mounted on the shaft.

These and other objects and features of the present invention will become more apparent from the following detailed description with reference to the accompanying drawings.

BRIEF DESCRIPTION OF DRAWINGS

FIG. 13 is a flowchart showing a time adjusting routine of FIG. 4;

DETAILED DESCRIPTION OF THE PREFERRED EMBODIMENT

Figure 1:
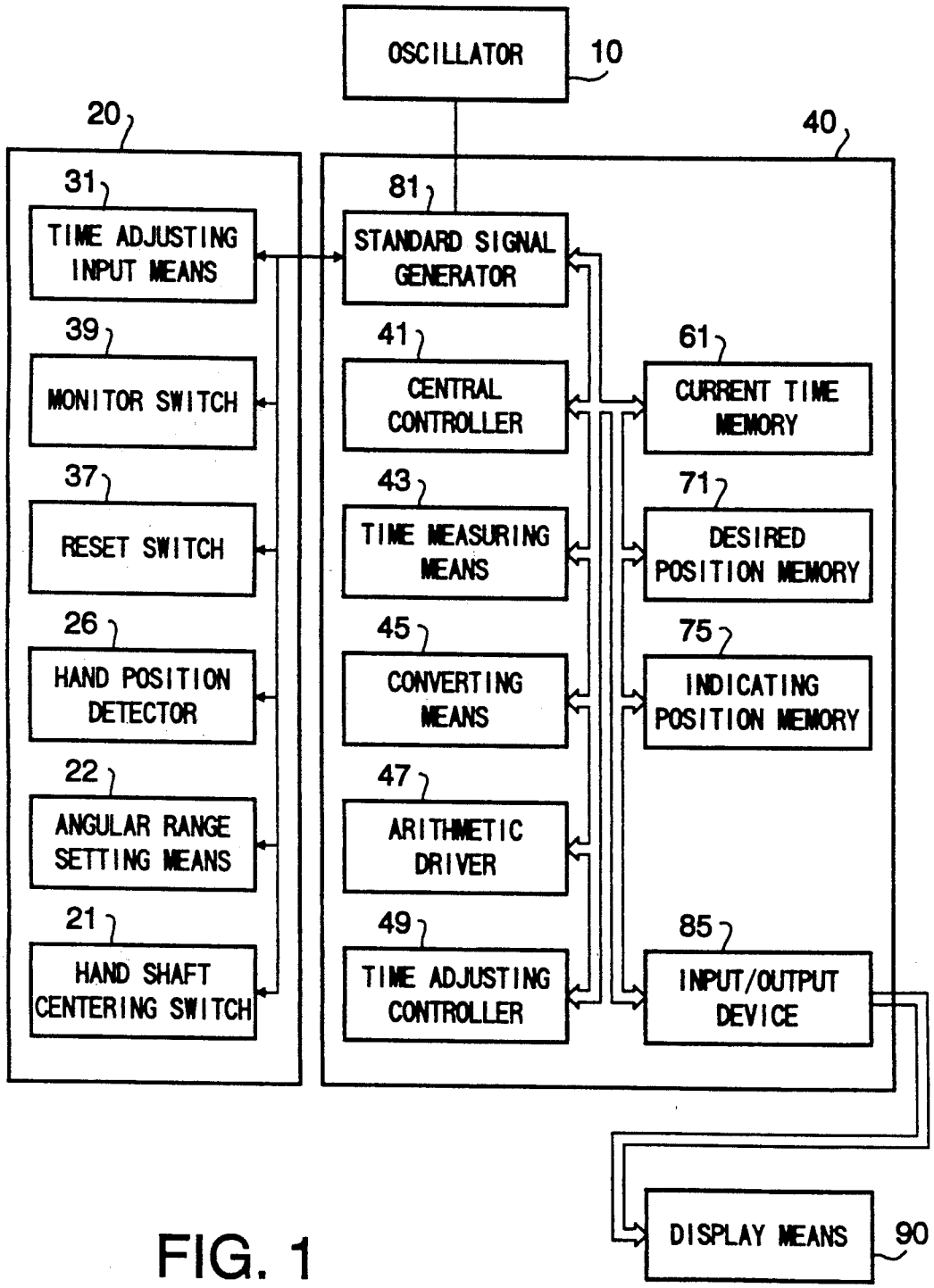
FIG. 1 is a block diagram showing a system for controlling an analog watch according to the present invention.

Referring to FIG. 1, a system for controlling an analog watch according to the present invention comprises an external input means 20 having a plurality of switches and a microcomputer 40 for controlling a display means 90 having reversely rotatable pulse motors for the analog watch.

The external input means 20 comprises a time adjusting input means 31, a monitor switch 39, an angular range setting means 22, a reset switch 37, a hand shaft centering switch 21, and a hand position detector 26. The user can operate the time adjusting input means 31 and the monitor switch 39., The angular range setting means 22 is operated by the manufacturer for setting the moving angular ranges of a minute hand and an hour hand.

The microcomputer 40 comprises a standard signal generator 81 connected to an oscillator 10, a central controller 41, a time measuring means 43, a converting means 45, an arithmetic driver 47, and a time adjusting controller 49. As a random access memory, a current time memory 61, a desired position memory 71, and an indicating position memory 75 are provided. An input-/output device 85 is connected to the display means 90.

Figure 2:
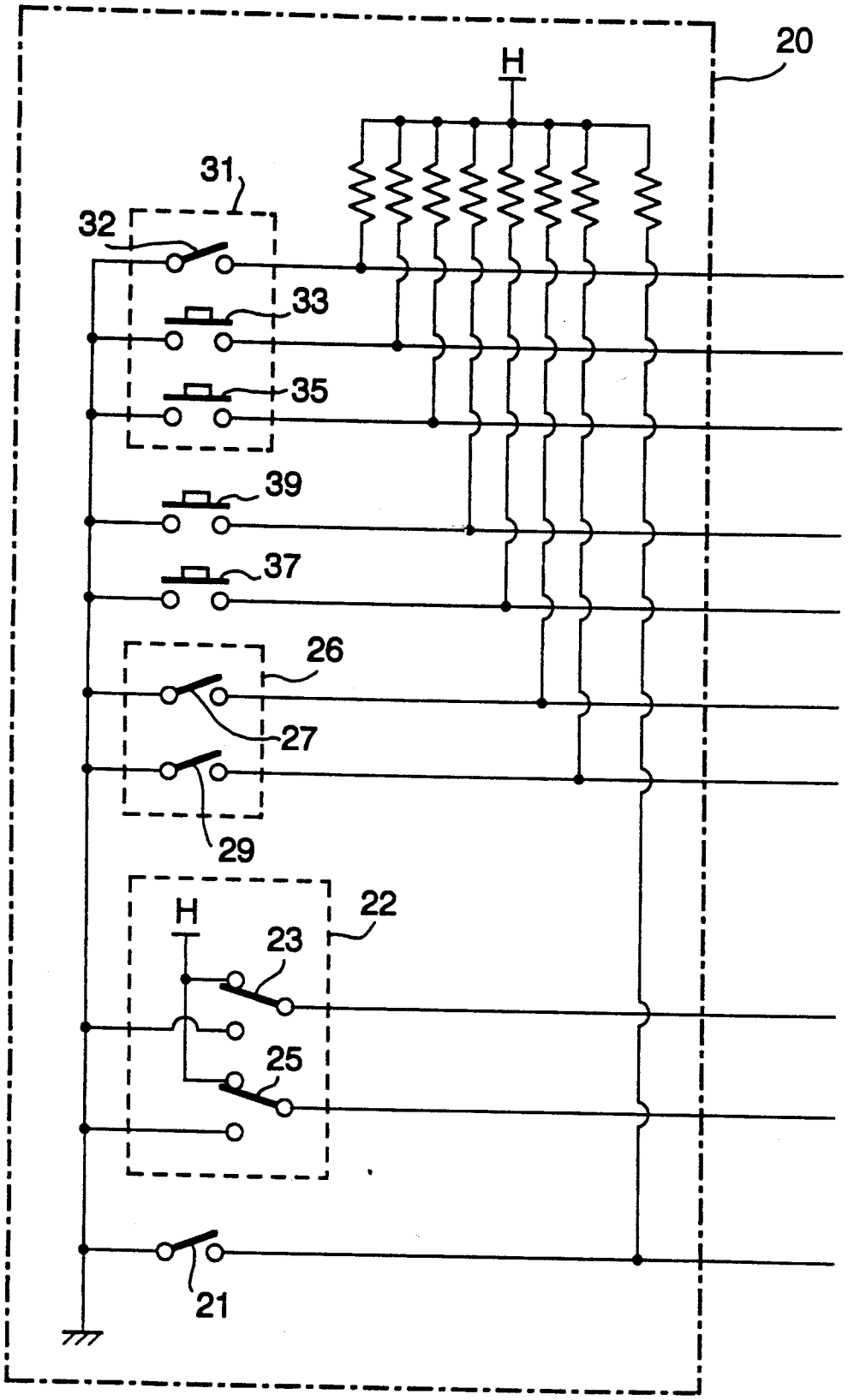
FIG. 2 is a circuit of an external input section of the system.

Referring to FIG. 2 showing the detail of the external input means 20, the time adjusting input means 31 has an adjusting mode switch 32, a minute adjusting switch 33, and an hour adjusting switch 35. By operating the time adjusting input means 31, the time displayed on the display means 90 is easily and rapidly adjusted.

The hand position detector 26 is provided on the underside of a dial and has a minute hand contact switch 27 and an hour hand contact switch 29 for detecting zero positions of the minute hand and hour hand shafts, respectively. The minute hand contact switch 27 detects the origin of a minute hand gear for determining a zero position of the minute hand shaft. The hour hand contact switch 29 detects the origin of an hour hand gear for determining a zero position of the hour hand shaft. When one of the contact switches 27 and 29 is closed, a "0" signal of a low (L) level is produced.

The angular range setting means 22 has a first setting switch 23 and a second setting switch 25 which are selectively closed in the factory. By selecting the combination of closing of the first and second setting switches, the hour hand and the minute hand are set to be driven on the dial within a range selected from 360 degrees, 240 degrees, 180 degrees and 120 degrees.

FIG. 12 shows examples of the dial used in the analog watch having the system of the present invention. A dial of FIG. 12*a* has a range of 360 degrees, which is set by closing both the first and second setting switches 23 and 25. A dial of FIG. 12*b* has a range of 240 degrees which is set by closing the second setting switch 25. A dial of FIG. 12*c* has a range of 180 degrees which is set by closing the first setting switch 23. A dial of FIG. 12*d* has a range of 120 degrees which is set by opening both setting switches.

Figure 3:
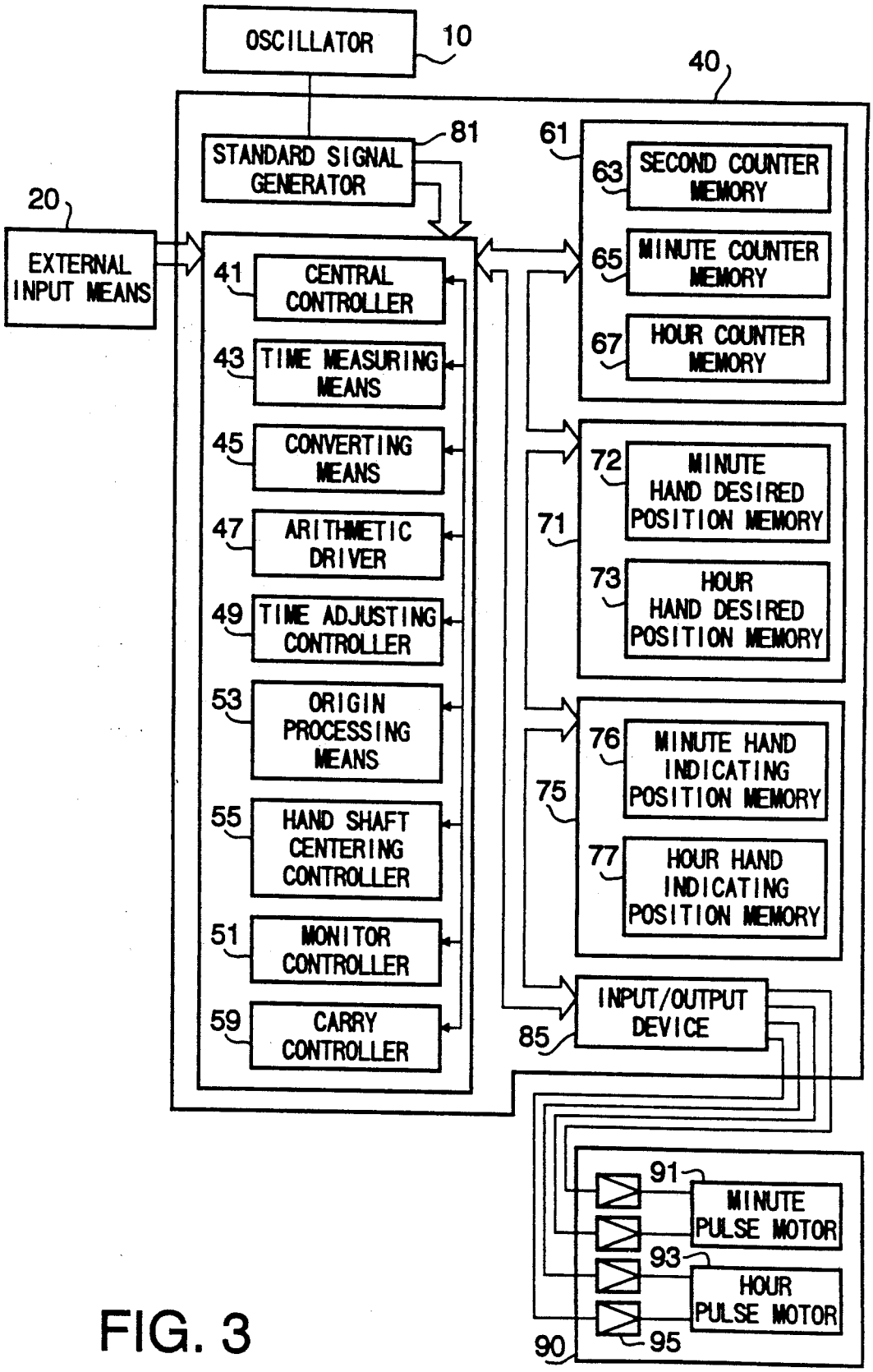
FIG. 3 is a block diagram showing a microcomputer of the system.

Referring to FIG. 3 showing the detail of the microcomputer 40, the standard signal generator 81 operates to divide a standard signal from the oscillator 10 to produce a machine cycle standard signal, a standard signal of 1 hertz, and other necessary standard signals. The standard signals are applied to the central controller 41 provided in an arithmetic and program control unit of the microcomputer 40. The central controller 41 is provided for controlling the devices included in the arithmetic and program control unit such as the time measuring means 43, converting means 45, arithmetic driver 47, and time adjusting controller 49.

The arithmetic and program control unit further comprises an origin processing means 53, a hand shaft centering controller 55, a monitor controller 51, and a carry controller 59.

The display means 90 comprises a minute pulse motor 91 for driving the minute hand, an hour pulse motor 93 for driving the hour hand, and operational amplifiers 95 connected to the input/output device 85. The input-/output device 85 is applied with stepping signals from the arithmetic driver 47 which are applied to the operational amplifiers 95. Thus, the pulse motors 91 and 93 are driven by the stepping signals to drive the minute and hour hands for indicating the time. By changing the connection between the output port and the pulse motor, the rotating direction of the motor is changed.

The current time memory 61 in the random access memory has a second counter memory 63, a minute counter memory 65, and an hour counter memory 67. The desired position memory 71 has a minute hand desired position memory 72 and an hour hand desired position memory 73. The indicating position memory 75 has a minute hand indicating position memory 76 for storing the position indicated by the minute hand and an hour hand indicating position memory 77 for storing the position indicated by the hour hand.

The time measuring means 43 is provided for measuring the current time based on the standard signal fed from the standard signal generator 81. The time measuring means 43 comprises a second counter, a minute counter, and an hour counter. A current time signal based on the measured current time is applied to the current time memory 61 and stored in the respective memories 63, 65 and 67.

The second counter counts a one-fifth hertz signal to measure the time every five seconds. The measured time is applied to the second counter memory 63 and stored therein. Since the second counter is operated every five seconds, the load on central controller 41 is reduced.

The converting means 45 operates to convert the current time, that is the current minute and the current hour stored in the current time memory 61, into a desired angular position for the minute hand and a desired angular position for the hour hand which are represented by 3-digit hexadecimal number. The calculated value of the desired position is applied to the desired position memory 71, and stored in the respective memories 72 and 73.

More particularly, the desired position of the minute hand is calculated from the times stored in the second counter memory 63 and the minute counter memory 65 of the current time memory 61. The desired position of the hour hand is calculated from the times stored in the minute counter memory 65 and the hour counter memory 67. The converting calculation is performed based on a scale factor set in the converting means 45 which is determined by the setting mode of the angular range setting means 22.

In an ordinary watch which is a circular dial watch, the angular range setting means 22 is set to the 360-degree mode by turning on both of the first and second setting switches 23 and 25. In the circular dial watch, 10 seconds from the second counter memory 63 is converted into 1 to be stored in the desired position memory 72. For example, 59 minutes 50 seconds is converted to 359 ($3590 \div 10 = 359$) which is converted into the corresponding hexadecimal number 167. The hexadecimal number is applied to the minute hand desired position memory 72 as a maximum value of the desired position of the minute hand and stored therein. In order to obtain the hour hand desired position, 2 minutes from the minute counter and hour counter memories 65 and 67 is converted into 1 to be stored. For example, 11 hours 58 minutes is converted to 359 ($718 \div 2 = 359$), and further converted to the hexadecimal number 167 which is applied to the hour hand desired position memory 73 as a maximum value of the desired position of the hour hand and stored therein. Namely, the minute hand desired position in the memory 72 is increased by 1 every 10 seconds, and the hour hand desired position in the memory 73 is increased by 1 every 2 minutes. The value of the memory 72 is between 0 and 359 (decimal number). The value of the memory 73 is between 0 and 359 (decimal number).

By setting the first setting switch 23 and the second setting switch 25 of the angular range setting means 22 to other setting mode, the scale factor of the converting means 45 is changed.

In the setting mode where only the second setting switch 25 is turned on (240-degree dial watch), the scale factor is changed, so that the value of the minute hand desired position memory 72 is incremented by 1 every 15 seconds of the second counter memory 63, and the value of the hour hand desired position memory 73 is incremented by 1 every 3 minutes of the minute counter memory 65. The maximum value of the memories 72 and 73 is set to 239 (decimal number).

In the setting mode where only the first setting switch 23 is turned on (180-degree dial watch), the scale factor is changed, so that the value of the memory 72 is incremented by 1 every 20 seconds of the second counter memory 63 and the value of the memory 73 is incremented by 1 every 4 minutes of the minute counter memory 65. The maximum value of the memories 72 and 73 is 179 (decimal number).

When both of the first and second setting switches 23 and 25 are turned off (120-degree dial watch), the value of the memory 72 is incremented by 1 every 30 seconds of the second counter memory 63, and the value of the memory 73 is incremented by 1 every 6 minutes of the minute counter memory 65. The maximum value of the memories 72 and 73 is 119 (decimal number).

The arithmetic driver 47 produces stepping signals which are applied to the minute pulse motor 91 and the hour pulse motor 93 through the input/output device 85 for stepping the minute hand and the hour hand. The indicating position memory 75 is operated to store the number of pulses of the stepping signals in the minute hand and hour hand indicating position memories 76 and 77 as the minute and hour indicating positions of 3-digit hexadecimal numbers, respectively.

In the system, the minute hand pulse motor 91 rotates 180 degrees with one pulse. The minute gear train is so arranged as to rotate the minute hand shaft by one degree when the minute pulse motor 91 is rotated 180 degrees. Similarly, the hour hand pulse motor 93 is rotated 180 degrees with one pulse to rotate the hour hand shaft by one degree through an hour gear train. Thus, the minute hand indicating position memory 76 stores a rotating angle of the minute hand shaft, and the hour hand indicating position memory 77 stores a rotating angle of the hour hand shaft.

Furthermore, the arithmetic driver 47 is provided for comparing the minute hand desired position stored in the desired position memory 72 of the desired position memory 71 with the actual minute hand indicating position stored in the indicating position memory 76 of the indicating position memory 75. If the value of minute hand desired position is larger than the value of minute hand indicating position, the arithmetic driver 47 produces a stepping signal for rotating the pulse motor 91 in the ordinary direction while the value of the indicating position memory 76 is incremented by 1 every one pulse of the stepping signal. If the desired position value is smaller than the indicating position value, a reverse stepping signal for rotating the pulse motor 91 in the reverse direction is produced while the value of the memory 76 is decremented by 1 every one pulse of the reverse stepping signal.

When the indicating position value coincides with the desired position value, output operation of the stepping signal to the pulse motor 91 is stopped.

Similarly, the actual hour hand indicating position in the hour hand indicating position memory 77 is compared with the hour hand desired position of the hour hand desired position memory 73 and a stepping signal is applied to the pulse motor 93 until the hour hand indicating position value coincides with the hour hand desired position value.

The origin processing means 53 is provided for positioning the minute hand shaft and the hour hand shaft at the respective zero positions. When the reset switch 37 is operated, the minute hand shaft and the hour hand shaft are returned to the zero positions. Namely, when a reset signal is applied to the origin processing means 53, the means 53 causes the arithmetic driver 47 to produce a stepping signal for driving the pulse motors 91 and 93. When the minute contact switch 27 of the hand position detector 26 detects that the minute hand shaft is positioned at the zero position, the stepping signal applied to the pulse motor 91 is stopped. When the hour contact switch 29 detects that the hour hand shaft is positioned at the zero position, the stepping signal applied to the pulse motor 93 is stopped. Furthermore, the counters in the time measuring means 43 and the memories 76 and 77 of the indicating position memory 75 are reset to cause the numbers stored therein zero.

When the monitor switch 39 is operated, the monitor controller 51 is operated such that the minute hand and the hour hand are rapidly reciprocated within a determined range of the dial. Namely, the monitor controller 51 operates to set a value stored in the minute hand desired position memory 72 to a maximum value, and to set a value stored in the hour hand desired position memory 73 to a minimum value.

The minimum value and the maximum value of the minute hand desired position are determined in dependency on the setting mode of the first and second setting switches 23 and 25 of the angular range setting means 22.

When the arithmetic driver 47 detects that the minute hand desired position value in the memory 72 coincides with the minute hand indicating position value in the memory 76, the minimum value is input in the memory 72. When the hour hand desired position and the hour hand indicating position coincide with each other, the maximum value is input in the memory 73. The changing operation from the maximum value to the minimum value is repeated for predetermined time periods. Thereafter, the desired positions for the minute and hour hands are calculated by the converting means 45 based on the times stored in the current time memory 61 and the calculated desired positions are input in the desired position memory 71, thereby returning the system in the normal operation.

The hand shaft centering controller 55 is provided for locating the minute hand and the hour hand at a central position in the sector dial, thereby making it possible to easily attach the minute and hour hands on respective shafts at the manufacturing or the repairing of the watch. When the hand shaft centering switch 21 is turned on and the reset switch 37 is operated, the minute hand and hour hand shafts are positioned at respective zero positions. A pulse signal having pulses corresponding to a half of the maximum value is applied to the display means 90 through the input/output device 85. Thus, both hand shafts are positioned at the respective central positions on the dial. Namely, the minute hand shaft is located at the thirty-minute position and the hour hand shaft is located at the six-hour position.

When the adjusting mode switch 32 of the time adjusting input means 31 is turned on for adjusting the time represented by the hands, the time adjusting controller 49 detects that the hour and minute adjusting switches 35 and 33 are turned on. When the minute adjusting switch 33 or the hour adjusting switch 35 is turned on, each counter of the time measuring means 43 is incremented with 1 and the arithmetic driver 47 is operated. The minute hand and the hour hand are intermittently rotated at every closing of the switches 33 and 35, as described in detail hereinafter.

When the minute counter is increased and the counter goes to 0 from 59, the minute counter produces a carry signal which is applied to the hour counter for increasing the hour counter. However, if the minute counter is increased in accordance with the operation of the minute adjusting switch 33, the carry controller 59 is operated for preventing the production of the carry signal.

The operation of the system will be described hereinafter.

Figure 4:
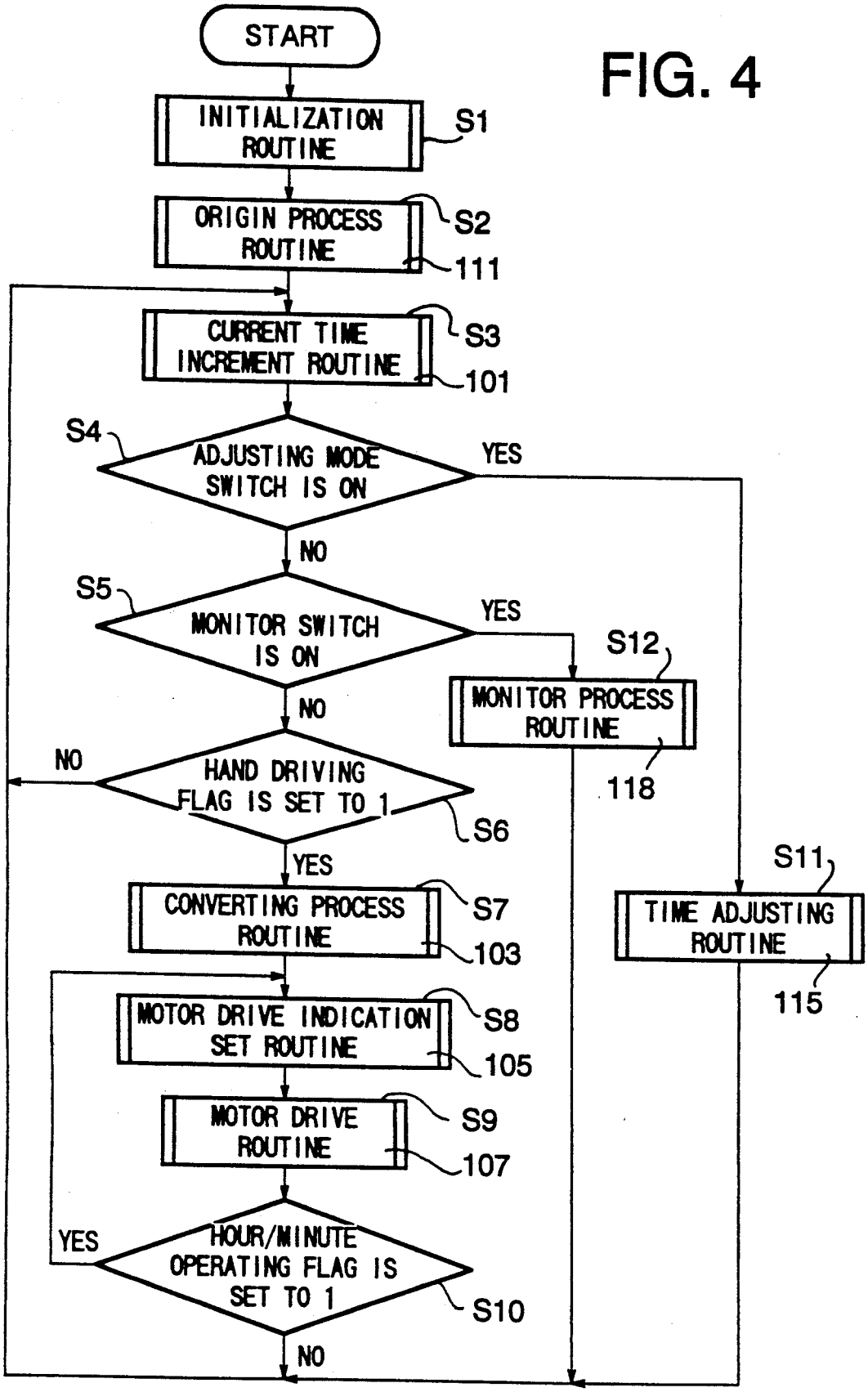
FIG. 4 is a flowchart showing an operation of the system.

The main routine of the system is described with reference to the flowchart of FIG. 4.

At a step S1, an initialization is performed in accordance with an initial setting routine. In the initial routine, random access memories are reset, a melody IC is checked and reset, and the pulse motors 91 and 93 are set to rotate in the ordinary directions. At a step S2, an origin process routine 111 is performed by operating the reset switch 37, which will be described hereinafter in detail.

At a step S3, a current time increment routine 101 is performed. In accordance with the routine 101, the time measuring means 43 measures the time every 5 seconds with the second, minute and hour counters based on the standard signals, and the measured times are stored in the second, minute and hour counter memories 63, 65 and 67 of the current time memory 61, respectively. Thereafter, a hand driving flag is set to 1.

At steps S4 and S5, it is determined whether the time adjusting mode switch 32 and the monitor switch 39 are turned on or not. When it is determined that the switches are turned off and that the hand driving flag is set at steps S4, S5 and S6, a converting process routine 103 is performed by the converting means 45 at a step S7.

In accordance with the converting process routine 103, the values of the second and minute counter memories 63 and 65 of the current time memory 61 are read, and the value read from the minute counter memory 65 is converted into the second unit for calculating the value of the minute hand desired position of 3-digit hexadecimal number with the scale factor determined by the setting mode of the first and second setting switches 23 and 25. The calculated value of minute hand desired position is stored in the minute hand desired position memory 72 of the desired position memory 71.

Furthermore, the values of the minute and hour counter memories 65 and 67 are read, and the value read from the hour counter memory 67 is converted into the minute unit for calculating the value of the hour hand desired position of 3-digit hexadecimal number. The calculated value of hour hand desired position is stored in the hour hand desired position memory 73.

At a step S8, a motor drive indication set routine 105 is provided for the arithmetic driver 47, which will be described hereinafter in detail. At a step S9, a motor drive routine 107 is performed, which will be also described hereinafter in detail.

At a step S10, it is determined whether minute and hour hand operating flags for the minute and hour hands are set to 1 or not. If yes, the program returns to the step S8. If not, the program returns to the step S3. At the step S6, if the hand driving flag is not set, the program returns to the step S3.

At the step S4, if it is determined that the time adjusting mode switch 32 is turned on, the program goes to a step S11 in which a time adjusting routine 115 is performed. At the step S5, if it is determined that the monitor switch 39 is turned on, the program proceeds to a step S12 where a monitor process routine 118 is performed.

The operation of the motor drive indication set routine 105 is described with reference to the flowcharts of FIGS. 5 and 6. The minute and hour hand desired positions stored in the desired position memory 71 and the minute and hour hand indicating positions stored in the indicating position memory 75 are read.

The minute hand desired position is compared with the minute hand indicating position. If both of the values coincide with each other, the minute hand operating flag is reset. If the desired position is different from the indicating position, the minute hand operating flag is set to 1. If the desired position is larger than the indicating position, a plus (+) direction flag is set. If the desired position is smaller than the indicating position, a minus (−) direction flag is set.

Figure 6:
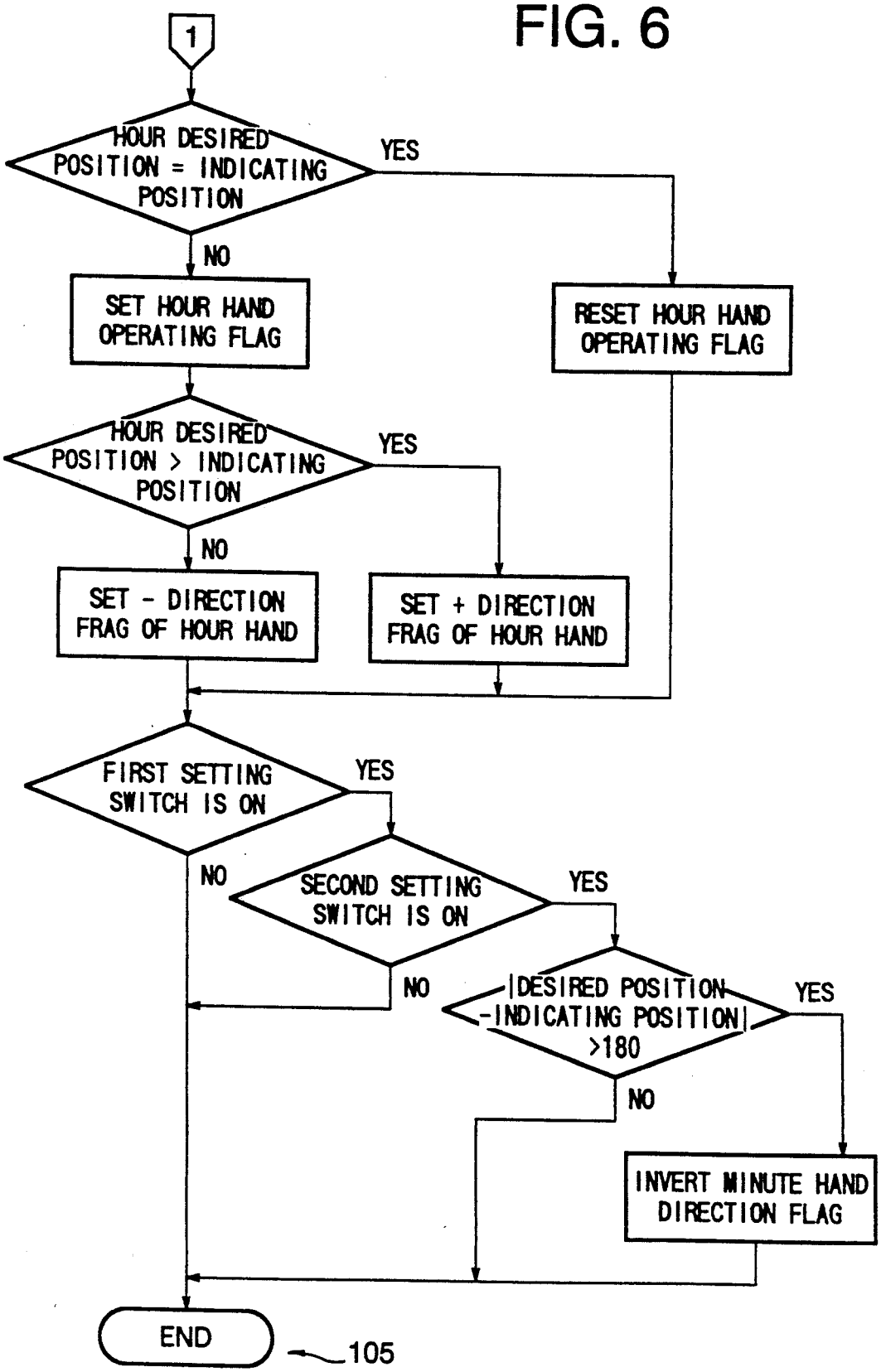
FIG. 6 is a flowchart showing the other part of the routine of FIG. 5.

As shown in FIG. 6, the hour hand desired position is compared with the hour hand indicating position. The program is performed in the same manner as that of the minute hand. Namely, if both of the values coincide with each other, the hour hand operating flag is reset. If not, the operating flag is set to 1. If the desired position is larger than the indicating position, a plus direction flag is set, and if the desired position is smaller than the indicating position, a minus direction flag is set.

Thereafter, the setting mode of the first and second setting switches 23 and 25 is determined. If both of the switches are turned on, which means that the driving range of the minute hand and hour hand is set at 360 degrees, it is determined whether the difference between the desired position and the indicated position of the minute hand is larger than 180 (decimal number) or not. If yes, the direction of the minute hand direction flag is inverted. The reason of the inversion will be described hereinafter. The program terminates and the motor drive routine 107 is started.

Figure 7:
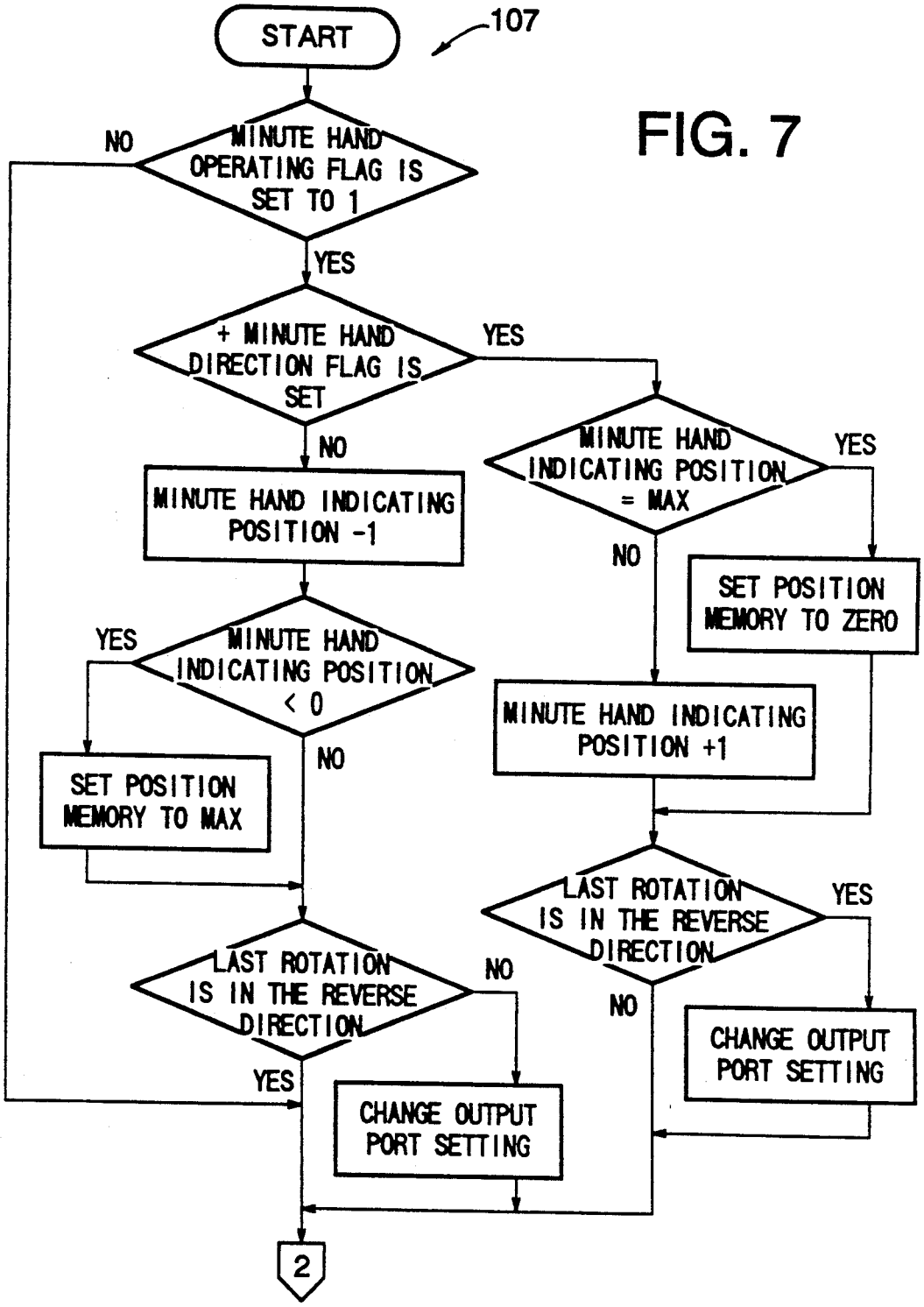
FIG. 7 is a flowchart showing a part of a pulse motor drive routine of FIG. 4.
Figure 8:
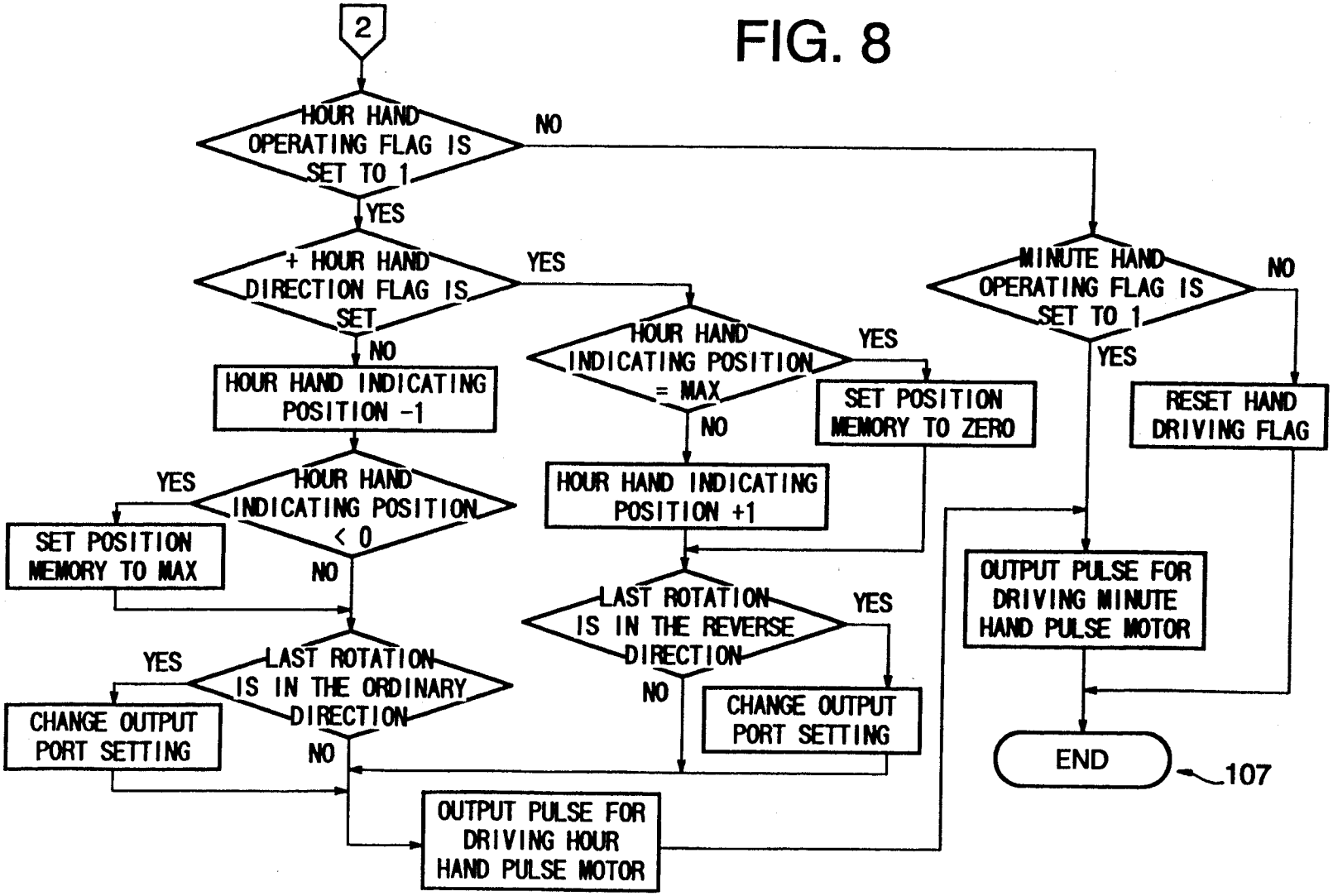
FIG. 8 is a flowchart showing the other part of the routine of FIG. 7.

Describing the operation of the motor drive routine 107 with reference to the flowchart of FIGS. 7 and 8, if the minute hand operating flag is set to 1, it is determined whether the plus direction flag of the minute hand is set or not. If the plus direction flag is set, it is determined whether the minute hand indicating position is the maximum value or not. If yes, the minute hand indicating position memory 76 is previously set to 0 before the minute hand is driven by the motor. If not, 1 is previously added to the value of the memory 76. Furthermore, it is determined whether the minute hand pulse motor 91 is rotated in the reverse (−) direction at the last time or not. If the motor 91 was rotated in the reverse direction, for example in the sector dial watch, an output port of the input/output device 85 is changed so as to produce the stepping signal for rotating the pulse motor 91 in the ordinary (+) direction.

If the minute hand plus direction flag is not set, 1 is subtracted from the indicating value stored in the memory 76. It is determined whether the value of the memory is smaller than 0. If yes, the maximum value is set to the memory 76. Namely, for example in the circular dial watch, the minute hand indicating position is preliminarily set to the maximum value (59) from 0. It is determined whether the pulse motor 91 is rotated in the reverse (−) direction at the last time or not. If not, the output port of the input/output device 85 is changed so as to produce the stepping signal for rotating the pulse motor 91 in the reverse (−) direction.

As shown in FIG. 8, if the hour hand operating flag is set to 1, the program is performed in the same manner as that of the minute hand. Namely, determination is made about the set of the plus direction flag of the hour hand. If the flag set is determined, and the hour hand indicating position is the maximum value, the hour hand indicating position memory 77 is set to 0. If the value is not the maximum, 1 is added to the value of the memory 77. If the hour hand pulse motor 93 is rotated in the reverse (−) direction at the last time, an output port of the input/output device 85 is changed so as to produce the stepping signal for rotating the pulse motor 93 in the ordinary (+) direction.

If the hour hand plus direction flag is not set, 1 is subtracted from the memory 77. If the value of the memory becomes smaller than 0, the maximum value is set to the memory 77. If the pulse motor 93 is rotated in the ordinary (+) direction the last time, the output port of the input/output device 85 is changed so as to produce the stepping signal for rotating the pulse motor 93 in the reverse (−) direction.

The input/output device 85 produces the stepping signal of one pulse which is applied to the hour hand pulse motor 93. The stepping signal of one pulse is applied to the minute hand pulse motor 91.

If both of the operating flags of the minute and hour hands are reset, namely when the minute hand indicating position is equal to the minute hand desired position and also the hour hand indicating position coincides with the desired position, the hand driving flag is reset, and the program terminates.

The operation at the time when the minute hand desired position is 0 and the minute hand indicating position is 59 in the sector dial watch is as follows.

Figure 5:
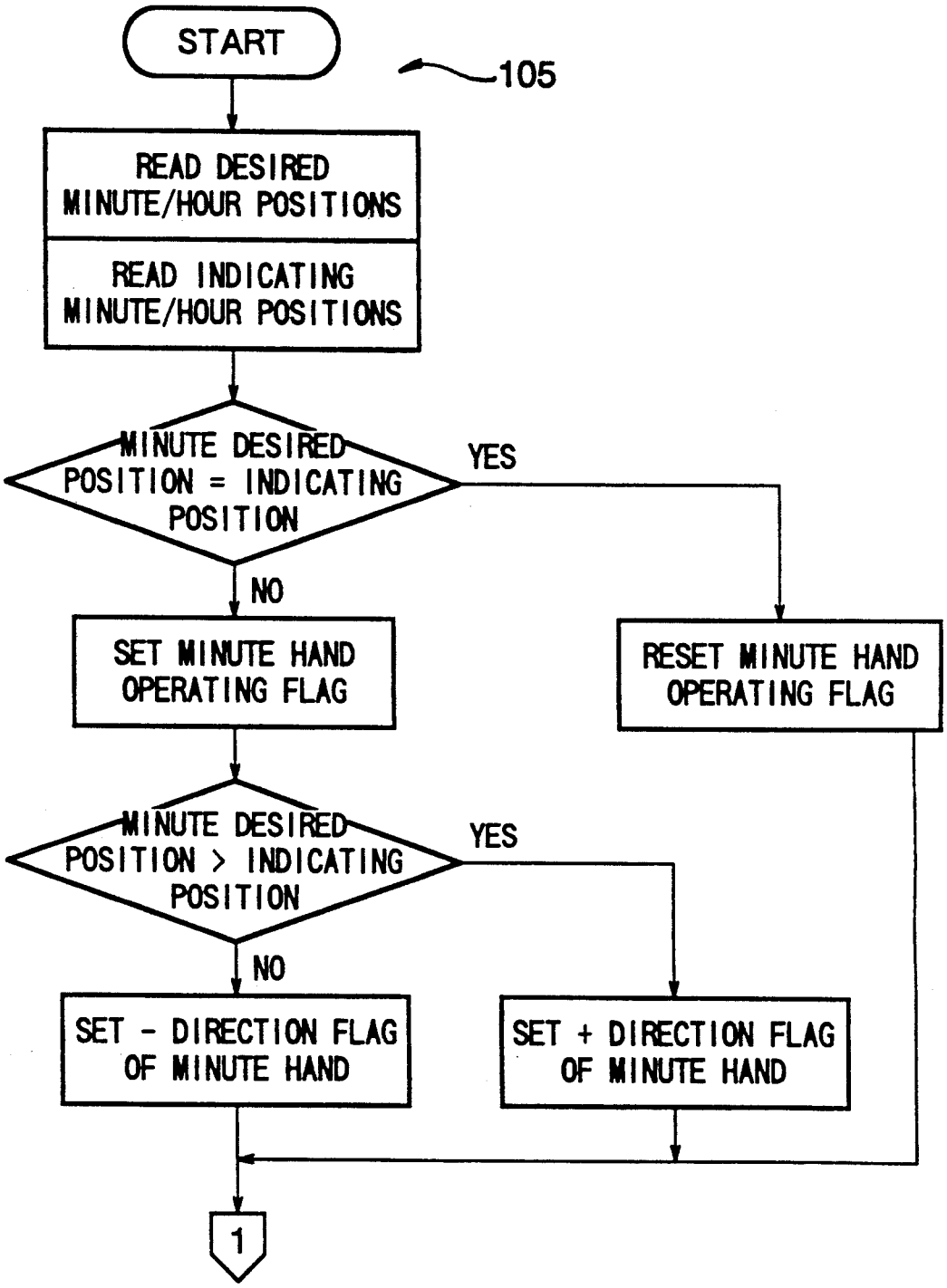
FIG. 5 is a flowchart showing a part of a time indication set routine of FIG. 4.

Since the minute hand desired position is smaller than the indicating position, the minus direction flag is set in the program of FIG. 5. Thus, the minute hand is continuously driven by the motor in accordance with the program of FIG. 5 to FIG. 8 in the reverse direction until the minute hand reaches the zero position. Namely, the minute hand is quickly returned to the zero position.

In the circular dial watch, the minus direction flag is inverted by the program of FIG. 6. Thus, the minute hand is driven from 59 to 0.

The origin process routine 111 is described with reference to the flowchart of FIG. 9. First, it is determined whether the first and second setting switches 23 and 25 are turned on or not. If both of the switches are turned on (the circular dial watch), the ordinary direction flags of the minute and hour hands are set so that the output ports of the input/output device 85 are set to produce the stepping signals for rotating the pulse motors 91 and 93 in the ordinary directions.

Thereafter, a switch-off check routine 111*a* is performed for temporarily turning off the minute and hour contact switches 27 and 29 if the switches are turned on.

Figure 10:
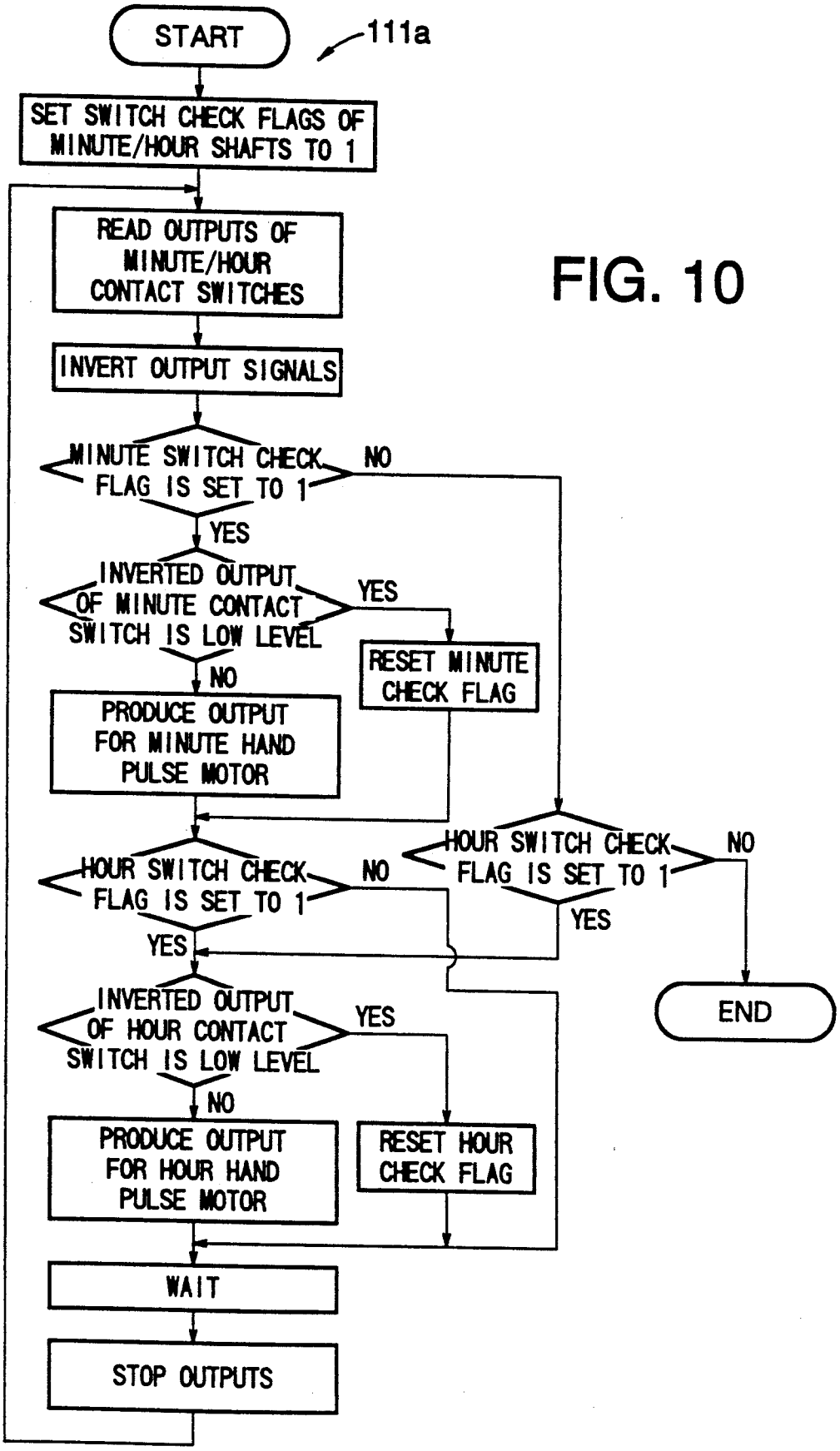
FIG. 10 is a flowchart showing a switch-off check routine of FIG. 9.

Referring to FIG. 10 showing the flowchart of the switch-off check routine 111*a*, switch check flags for the minute hand shaft and the hour hand shaft are set to 1, respectively, so that output signals from the contact switches 27 and 29 are read.

The switches 27 and 19 are so arranged that when the contact switch is turned on, a "0" signal of low (L) level is produced, as is understood from FIG. 2. Therefore, the read out output signals are inverted.

It is determined whether the minute hand switch check flag is set to 1 or not. If yes, it is determined whether the inverted output of the minute contact switch 27 is at the low (L) level or not. If not (switch on), an output signal is applied to the minute hand pulse motor 91 to rotate it 180 degrees.

Similarly, the setting of the hour hand check flag is determined and the high level of the output from the hour contact switch 29 is determined. Thus, an output signal of one pulse is applied to the hour hand pulse motor 93 to rotate it 180 degrees. After a predetermined time waiting, both of the output signals are stopped.

The program is repeated. If the inverted output of the contact switch 27 is the low (L) level (switch off), the minute check flag is reset. If it is determined that the inverted output of contact switch 29 is at the low (L) level, the hour check flag is reset. It is determined that the contact switches 27 and 29 are turned off. After the predetermined time waiting, the program is returned and terminated.

If each of the outputs read from the contact switches is a "1" signal of a high (H) level, it is determined that the contact switches are turned off. Thus, the minute and hour check flags are reset based on the inverted signals. No stepping signal is produced and the program terminates.

Figure 9:
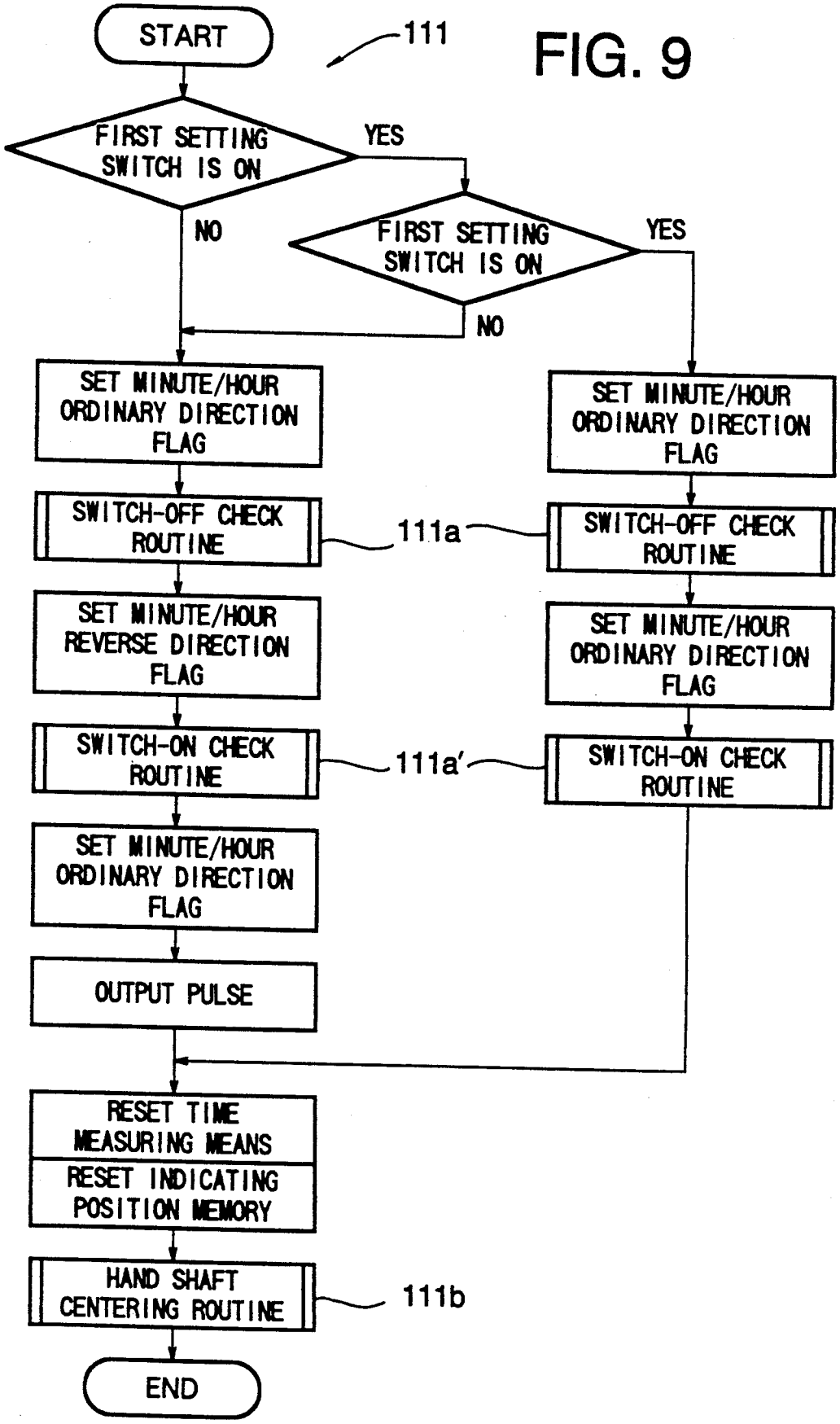
FIG. 9 is a flowchart showing an origin process routine of FIG. 4, and a hand shaft centering routine.

In the origin process routine 111, the ordinary direction flag is set again and a switch-on check routine 111*a'* of FIG. 9 is performed in which the contact switches 27 and 29 are turned on. Although the detail of the switch-on check routine 111*a'* is not shown in the flowchart, the routine 111*a'* is approximately the same as the switch-off check routine 111*a*, except for the step for inverting the outputs of the switches.

In the routine 111*a'*, the stepping signal is produced for operating the pulse motors until the contact switches are turned on to produce the "0" signals of the low level. Thus, both the minute and hour hand shafts are set at the origin.

In the program of FIG. 9, if one of the setting switches 23 and 25 is turned off (sector dial watch), the ordinary direction flags for minute and hour hands are set and the switch-off check routine 111*a* is performed. After the execution, the reverse direction flags are set so that the output port of the input/output device 85 produces the stepping signals for rotating the pulse motors 91 and 93 in the reverse directions. Thereafter, the switch-on check routine 111*a'* is performed. When the contacts switches are turned on, the motors are stopped.

Figure 12A:
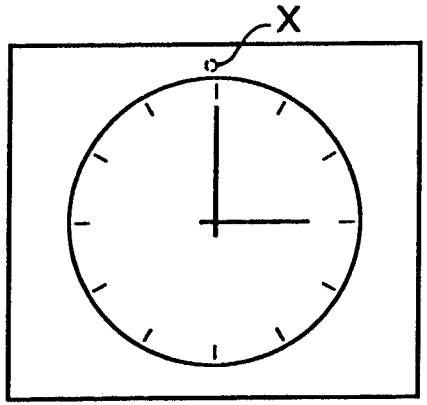
FIGS. 12*a* to 12*d* are schematic plan views showing examples of a dial of the analog watch.
Figure 12B:
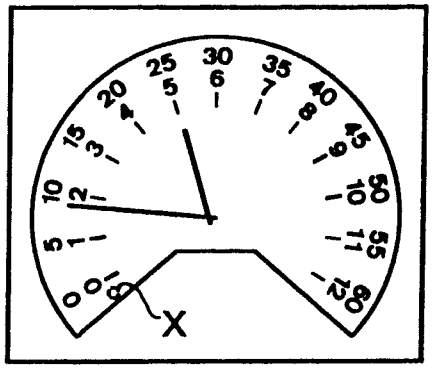
Figure 12C:
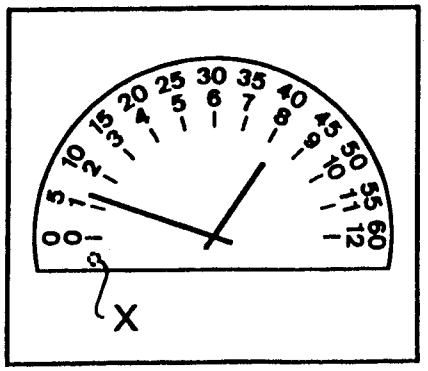
Figure 12D:
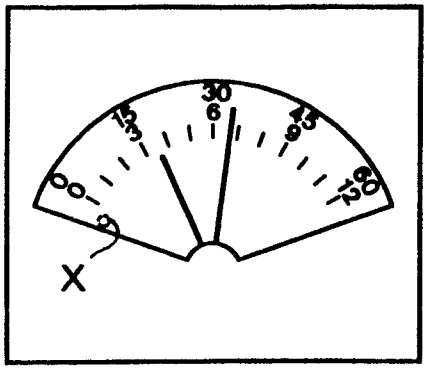

In the sector dial watch, the minute contact switch 27 and the hour contact switch 29 are located at a position X in FIGS. 12*b* to 12*d* outwardly deviated from the 0 position in order to prevent the contacts from wearing as described below. Therefore, both the hand shafts are located at the angularly deviated position. Accordingly, a program for positioning the shafts at the origin (0 position) is provided as follows.

When the motors stop, the ordinary direction flags are set to produce the stepping signals for rotating the pulse motors in the ordinary directions. The stepping signal of, for example 5 pulses corresponding to the deviation is applied to the pulse motors. Thus, both hand shafts are positioned at the origin, and the switches are turned off. Since the switches are not closed during the ordinary operation, contacts are prevented from wearing.

By the origin process routine, the minute hand and hour hand shafts are located at zero position. Therefore, if there occurs that the hand is not located at the zero position, the fact means that the hand is set at an angularly deviated position. Thus, the hand can be easily set at the correct position.

The hand shaft centering routine 111*b* is executed after the origin process routine has ended. Before the hand shaft centering, the reset switch 37 is closed, so that the second, minute and hour counters of the time measuring means 43 and memories 76 and 77 of the indicating position memory 75 are reset.

Figure 11:
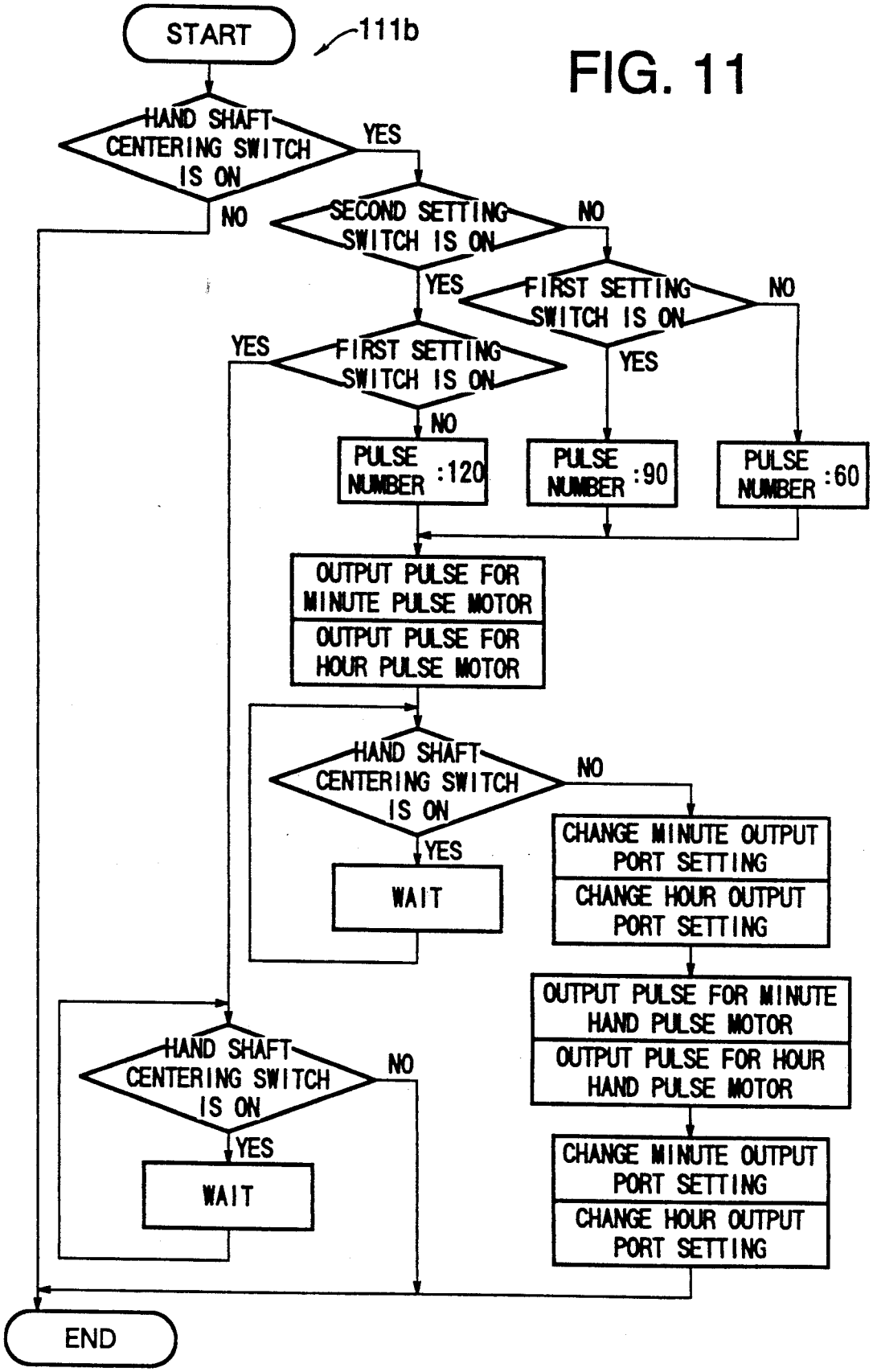
FIG. 11 is a flowchart showing a hand shaft centering routine of FIG. 9.

The operation of the hand shaft centering routine 111*b* for the sector dial watch is described with reference to the flowchart of FIG. 11. The routine starts when the hand shaft centering switch 21 is turned on. If the hand shaft centering switch 21 is turned off, the program terminates.

If the switch 21 is turned on, the number of the stepping signal pulse is determined in accordance with the type of the dial dependent on conditions of the first and second setting switches 23 and 25.

If the second switch 25 is turned on and the first switch 23 is turned off, the number of pulse is set to 120 and the number is stored in a memory. If the second switch 25 is turned off and the first switch 23 is turned on, the number of pulse is set to 90 and the number is stored in the memory. If both switches are turned off, the number of pulse is set to 60 and stored.

The stepping signal having the corresponding number of pulses is produced for driving the pulse motors 91 and 93 through the input/output device 85, so that the respective shafts are rotated to an angular position corresponding to a central position of the dial.

It is determined whether the hand shaft centering switch 21 is turned on or not. If the switch is turned on, the program waits until the switch is turned off. In the waiting period, hands are attached on respective shafts. When the switch 21 is turned off, the output ports of the input/output device 85 are set to inverse the stepping signal. Therefore, the stepping signal of the stored number of pulse is produced for rotating the motors in the reverse direction. Consequently, the attached hands are rotated to the zero position. Thereafter, the output port of the input/output device 85 is set so as to produce the stepping signal for rotating the motors in the ordinary directions.

If both switches 23 and 25 are turned on (circular dial watch), the program waits without rotating the hand shafts until the switch 21 is turned off. In the waiting period, the minute and hour hands are mounted on the respective shafts. Since the hands are mounted at the central position of the dial, the hands can be easily mounted.

An outline of the time adjusting routine 115 performed by the time adjusting controller 49 is given.

First, the adjusting mode switch 32 is turned on. If the minute adjusting switch 33 is turned on within 2 seconds, the minute hand is advanced by 6 degrees corresponding to 1 minute at every closing of the switch 33. If the switch 33 is turned on for 2 seconds or more, the minute hand is advanced by 30 degrees corresponding to 5 minutes. When the hour adjusting switch 35 is turned on, the hour hand is advanced by 30 degrees (1 hour) at every closing of the switch 35. If the switch 35 is turned on for 2 seconds or more, the hour hand is quickly advanced by 30 degrees.

The operation of the routine 115 is described with reference to the flowchart of FIG. 13. If the number stored in the second counter memory 63 of the current time memory 61 is not zero, 1 is added to the minute counter of the time measuring means 43 to zero the second counter. It is determined whether the adjusting mode switch 32 is turned on or not. If the switch is turned on, it is determined whether the minute adjusting switch 33 is turned on or not. If yes, which means that a condition of the switch 33 is changed, a timer is started and 1 (1 minute) is added to the minute counter of the time measuring means 43. It is determined whether the switch 3 is turned on for 2 seconds or of the time measuring means 43. Then, converting process routines 103', motor drive indication set routine 105' and motor drive routine 107' which are the same as the routine 103, 105 and 107, respectively, are performed for driving the minute hand by 6 degrees corresponding to the added 1 minute. Since the minute hand indicating position is equal to the desired position, the minute hand operating flag is reset, and the program returns.

Thereafter, the turning-on of the adjusting mode switch 32 and the minute adjusting switch 33 is determined again. Since the condition of the adjusting switch is not change, it is determined whether the switch 33 is turned on for 2 seconds or more, the time is determined by the timer. If not, the above described operation is repeated. Thus, the minute hand is rotated by 6 degrees at every closing of the minute adjusting switch 33.

If the minute adjusting switch 33 is turned on for 2 seconds or more, it is determined whether the minute counter memory 65 is 0 or a multiple number of 5. If not, the minute counter is incremented with 1 until the number in the memory 65 becomes 0 or a multiple number of 5. Thereafter, the routines 103', 105' and 107' are performed for driving the minute hand. Thus, the minute hand is continuously advanced by 30 degrees corresponding to the 5 minutes on the dial as long as the switch 33 is closed.

If the minute adjusting switch 33 is turned off, it is determined whether the hour adjusting switch 35 is turned on or not. If the switch is turned on, a timer is started and 1 is added to the hour counter of the time measuring means 43. After the prosecution, the routines 103', 105' and 107' are performed for driving the hour hand. Thus, the hour hand is rotated by 30 degrees corresponding to the added 1 hour at every closing of the hour adjusting switch 35.

If the hour adjusting switch 35 is turned on for 2 seconds or more, 1 is added to the hour counter and the hour hand is advanced by 30 degrees. The hour hand is continuously rotated as long as the hour adjusting switch 35 is closed. Thus, the minute and hour can be easily and quickly adjusted.

When the adjusting mode switch 32 is turned on, since the carry signal is not produced from the carry controller 39 for inhibiting the minute counter from carrying the hour count, the hour counter is prevented from increasing. Consequently, it is not necessary to adjust the hour hand again after the correction of the minute hand.

Figure 14:
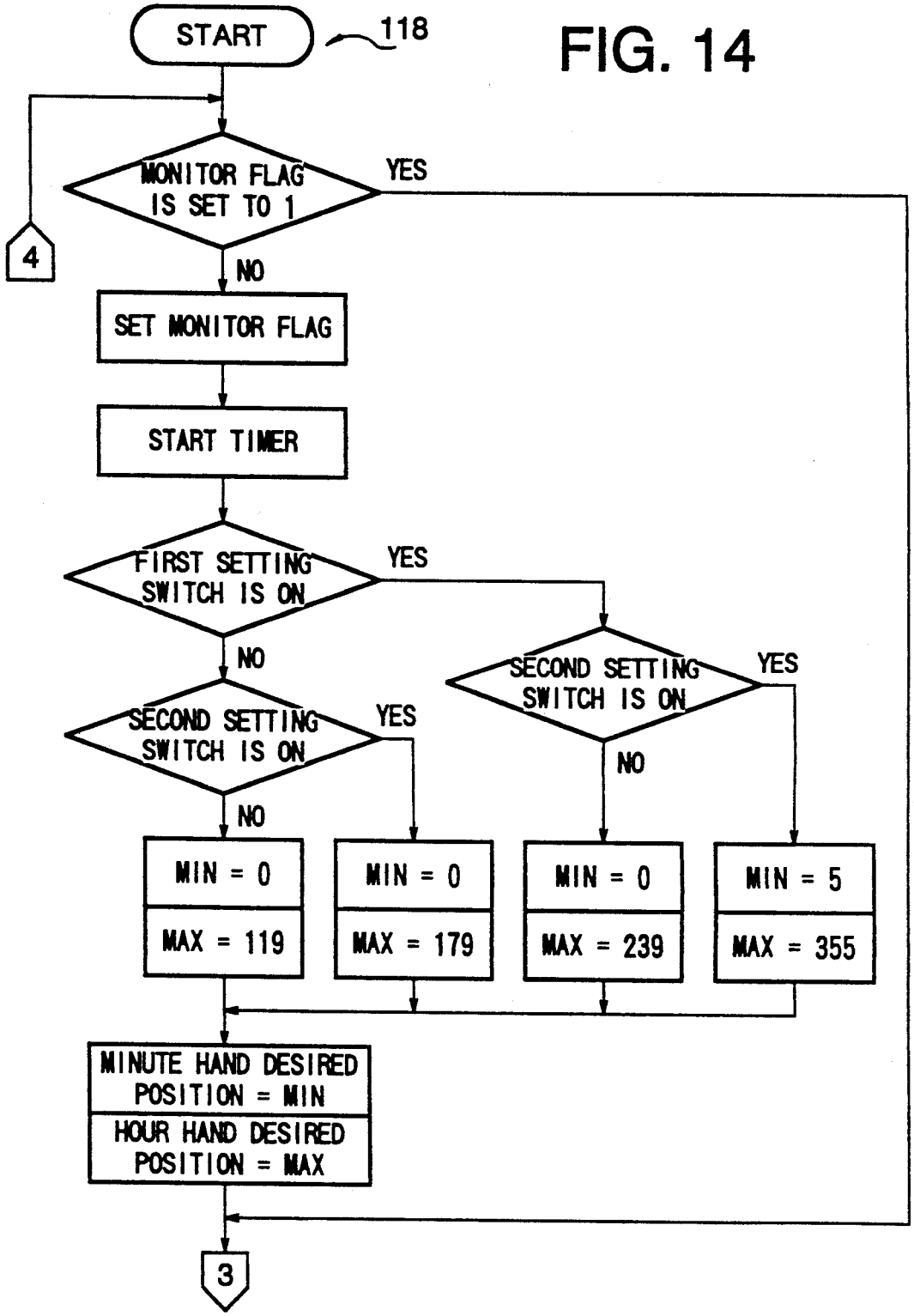
FIG. 14 is a flowchart showing a part of a monitor process routine of FIG. 4.

The monitor process routine 118 performed by the monitor controller 51 will be described hereinafter with reference to the flowcharts of FIGS. 14 and 15.

It is determined whether a monitor flag is set to 1 or not. If not, the monitor flag is set to 1 and a timer is set so that a time for demonstrating the operations of the minute and hour hands, for example 20 seconds is set. After that, the ranges between the maximum and the minimum of the respective hands are set in accordance with the operating conditions of the setting switches 23 and 25. In an example, the minimum desired position of the minute hand of the sector dial watch is set to 0, and the maximum desired position is set to 119, or 179, or 239 degrees in accordance with the type of the watch. In the circular dial watch, the minimum and maximum desired positions are set to 5 degrees and 355 degrees. The set positions are stored in the minute hand desired position memory 72 of the memory 71. Similarly, the maximum and minimum desired positions of the hour hand are set and stored in the hour hand desired position memory 73.

Figure 15:
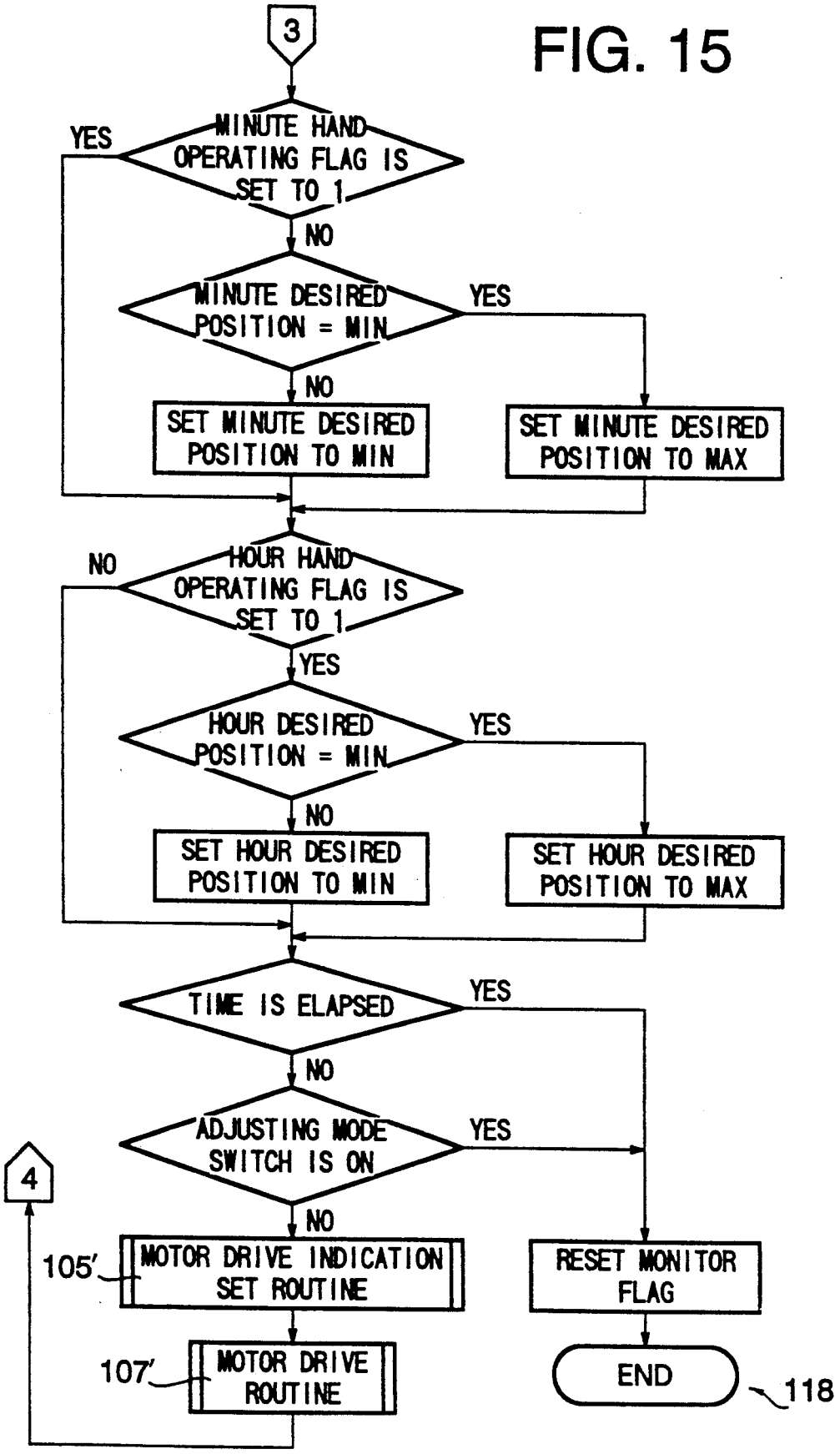
FIG. 15 is a flowchart showing the other part of the routine of FIG. 14.

In the flowchart of FIG. 15, it is determined whether the operating flags of the minute and hour hands are set to 1, respectively. If the minute hand indicating position is not the minimum position, the flag is set by the routine 105 of FIG. 5. If the hour hand indicating position is not maximum position, the flag is set. Thereafter, it is determined whether the demonstrating time is elapsed and the adjusting mode switch 32 is turned on. If not, the motor drive indication set routines 105' and the motor drive routine 107' are performed for driving the hands. The program returns to the step in which the set of the monitor flag is determined, and the program is repeated.

When the indicating positions of minute hand coincides with the desired position thereof, which is determined by the operating flags, the content of the memory 72 is read. In the example, since the memory 72 stores the minimum value, the maximum value of the desired position is stored in the memory 72. Similarly, if the indicating position of hour hand coincides with the desired position thereof, the content of the memory 73 is read. Since the memory 73 stores the maximum value, the minimum value is stored in the memory 73. Thus, the minute hand and the hour hand are reciprocated at a high speed in the opposite direction with each other.

After 20 seconds, the monitor flag is reset to display the current time. If the adjusting mode switch 32 is turned on, the monitor flag is reset. Thus, the program is terminated.

In the watch having the sector shaped dial, the minimum of the minute hand is the 0-minute position and the maximum is about 59-minute position, and the minimum of the hour hand is the 0-hour position and the maximum is the 12-hour position. In the watch of the circular dial, the minimum of the minute hand is the 1-minute position and the maximum is the 59-minute position, and the minimum of the hour hand is the 0-hour position and the maximum is a position adjacent the 12-hour position. Consequently, during the monitor operation, since the minute and hour hands do not contact the contact switches 27 and 29, contacts of the switches are prevented from wearing.

By reciprocating the minute hand and the hour hand, it is possible to direct person's notice to the watch.

In accordance with the present invention, the desired position memory is provided so that various values other than the current time can be stored, and the pulse motors are operated in accordance with the data stored in the memory for driving the minute hand and hour hand. Consequently, analog watch having multifunction is provided, and the analog watch having a sector-shaped dial can be provided.

While the invention has been described in conjunction with preferred specific embodiment thereof, it will be understood that this description is intended to illustrate and not limit the scope of the invention, which is defined by the following claims.

What is claimed is:

1. An analog timepiece having a standard signal generator, a reversely rotatable minute pulse motor and a reversely rotatable hour pulse motor which are operated by a standard signal form the standard signal generator, and time adjusting means for adjusting a time represented by a minute hand and an hour hand, comprising:

time measuring means for periodically producing a current time based on the standard signal fed from the standard signal generator;

a current time memory including a minute memory and an hour memory for storing the current time measured by the time measuring means;

converting means for periodically converting the current time stored in the current time memory into a minute hand desired position and an hour hand desired position;

a desired position memory for storing the minute hand desired position and the hour hand desired position which change with the current time;

an indicating position memory for storing a minute hand indicating position indicated by a minute hand and an hour hand indicating position indicated by an hour hand;

changing means for changing values of data stored in the current time memory, desired position memory, and indicating position memory, respectively;

minute arithmetic comparator means for periodically comparing the stored minute hand indicating position with the stored minute hand desired position and for producing a minute hand operating signal, including a rotating direction signal, dependent on an arithmetic operation when the minute hand indicating position is different from the minute hand desired position;

hour arithmetic comparator means for periodically comparing the stored hour hand indicating position with the stored hour hand desired position and for producing an hour hand operating signal, including a rotating direction signal, dependent on arithmetic operation when the hour hand indicating position is different from the hour hand desired position; and minute motor driving means, responsive to the minute hand operating signal for producing a minute pulse signal to operate the reversely rotatable minute pulse motor;

hour motor driving means responsive to the hour hand operating signal for producing an hour pulse signal to operate the reversely rotatable hour pulse motor, whereby each of the minute hand and the hour hand is rotated in a direction dependent on the respective rotating direction signals until the difference between the respective hand indicating positions and the hand desired position becomes zero, thereby indicating the current time.

2. An analog timepiece according to claim 1 wherein the time adjusting means comprises, input means for inputting a time adjusting signal, incrementing means responsive to the time adjusting signal for incrementing the current time stored in the current time memory with a predetermined value, whereby the desired positions of the minute and hour hands are increased, thereby operating the reversely rotatable minute pulse and hour pulse motors to rotate each of the hands by a predetermined angle.

3. An analog timepiece according to claim 1 wherein the time adjusting means comprises, a minute adjusting switch and an hour adjusting switch for inputting a minute adjusting signal and an hour adjusting signal, first incrementing means responsive to the minute and hour adjusting signals for incrementing numbers stored in a minute memory and an hour memory in the current time by one respectively at every input of the adjusting signals, first determining means for producing a quick adjusting signal when the minute adjusting switch is operated over a predetermined time, second incrementing means responsive to the quick adjusting signal for incrementing the number stored in the minute memory by five, whereby the desired positions of the minute hand is increased by the converting means, thereby operating the reversibly rotatable minute pulse motor to rotate the minute hand by 30 degrees corresponding to five as long as the minute adjusting switch is operated.

4. An analog timepiece according to claim 1 further comprising:

angular range setting means for setting an angular range, including a sector range smaller than 360 degrees, in which the minute hand and the hour hand are driven, said converting means being arranged to change a converting ratio in accordance with the angular range set by the angular range setting means so as to drive the minute hand and the hour hand within the set range.

5. An analog timepiece according to claim 1 further comprising:

a monitor switch for starting a monitor operation, input means for inputting one of a maximum desired position and a minimum desired position of the minute hand and one of a minimum desired position and a maximum desired position of the hour hand in the desired position memory, second determining means for determining a coincidence of the hand indicating position stored in the indicating position memory and the desired position stored in the desired position memory and for producing a coincidence signal, and changing means responsive to the coincidence signal for changing the stored maximum desired position into the minimum desired position, and changing the stored minimum desired position into the maximum desired position, whereby the minute hand and the hour hand are continuously reciprocated between the maximum and minimum positions.

6. An analog timepiece according to claim 2 wherein the time measuring means includes a minute counter and an hour counter for counting the standard signal and the minute counter is arranged to produce a carry signal when the count of the counter becomes zero from 59, which is applied to the hour counter.

7. An analog timepiece according to claim 6 further comprising:

carry control means responsive to the time adjusting signal for inhibiting the time measuring means from producing the carry signal during a minute adjusting operation.

8. An analog timepiece according to claim 4 further comprising:

a minute hand contact switch and an hour hand contact switch which are located at a position outwardly deviated from a zero position on a dial having a sector range, locating means for locating a shaft of the minute hand and a shaft of the hour hand at the positions of the minute hand switch and the hour hand switch, and first driving means for rotating both the shafts to the zero position.

9. An analog timepiece according to claim 4 further comprising:

a hand shaft centering switch for producing a shaft centering signal, and second drive means responsive to the shaft centering signal for rotating the minute hand and the hour hand to an angular position corresponding to a central position of a dial having a sector range.

* * * * *